United States Patent [19]

Hohsho et al.

[11] 4,105,720

[45] Aug. 8, 1978

[54] VARIABLE STAGE TYPE CARBURETOR

[75] Inventors: Yukio Hohsho; Kimiji Karino; Masakichi Momono; Yoshishige Oyama; Teruo Yamauchi, all of Katsuta; Takao Teranishi, Hitachi, all of Japan

[73] Assignee: Hitachi, Ltd., Japan

[21] Appl. No.: 828,670

[22] Filed: Aug. 29, 1977

Related U.S. Application Data

[63] Continuation of Ser. No. 713,989, Aug. 12, 1976, abandoned.

[30] Foreign Application Priority Data

Aug. 15, 1975 [JP] Japan ..... 50-98631

[51] Int. Cl.[2] ..... F02M 9/08

[52] U.S. Cl. ..... 261/34 A; 261/44 F; 261/52; 261/DIG. 56

[58] Field of Search ..... 261/34 A, 52, 44 F, 261/DIG. 56

[56] References Cited

U.S. PATENT DOCUMENTS

| | | | |
|---|---|---|---|
| 3,802,671 | 4/1974 | Klutho | 261/34 A |
| 3,937,768 | 2/1976 | Bier et al. | 261/44 F |
| 3,957,929 | 5/1976 | Gural et al. | 261/34 A |
| 4,005,161 | 1/1977 | Shimo et al. | 261/52 |

*Primary Examiner*—Tim R. Miles

*Attorney, Agent, or Firm*—Craig & Antonelli

[57] ABSTRACT

A variable stage type carburetor having a throttle valve and a movable venturi vane cooperative with the throttle valve. This carburetor further includes a negative pressure responsive device for forcedly shifting the venturi vane in a direction to be closed, irrespective of an opening of the throttle valve, when the negative pressure in the venturi portion is lowered to less than a given value, and an accelerator pump for additionally supplying fuel to an intake passage commensurate to the opening action of the throttle valve. The accelerator pump is effectively operated when the opening of the throttle valve remains at an angle no more than a given degree, while the negative pressure responsive device is effectively operated, when the opening of the throttle valve is at an angle no less than a given degree.

3 Claims, 4 Drawing Figures

VARIABLE STAGE TYPE CARBURETOR

CROSS REFERENCE TO THE RELATED APPLICATION

This application is a continuation of our copending application Ser. No. 713,989 filed on Aug. 12, 1976, now abandoned, for the invention Variable Stage Type Carburetor.

BACKGROUND OF THE INVENTION

This invention relates to a variable stage type carburetor and particularly to a variable stage type carburetor which can prevent a lean mixture charge at the time when the associated engine is operated with high load.

A variable stage type carburetor contemplates that the opening area of a venturi portion defined between a vane and the inner wall of an intake passage is varied by the vane operatively connected to a throttle valve via a link mechanism so that the venturi negative pressure is controlled, while a fuel metering area is varied through cooperation of a jet needle connected to the vane with an orifice provided in the venturi wall surface confronting the vane so that an air-fuel ratio is controlled to a given value. This type of carburetor can set the venturi negative pressure at a considerably high value and has an excellent fuel atomizing characteristics.

However, such shortcoming have been encountered that, since the vane and the throttle valve are mechanically associated, if the load acting on the engine becomes greater, then the venturi negative pressure becomes smaller due to low R. P. M. of the engine despite the opening of the throttle valve is large, thereby decreasing the flow rate of fuel with the resulting leaner mixture charge.

BRIEF SUMMARY OF INVENTION

One object of the present invention is to provide a variable stage type carburetor capable of maintaining an air-fuel mixture at a given value of air-fuel ratio at the time of full load running of the engine.

The present invention features that there are provided a pump adapted to additionally supply the fuel in response to the opening of the throttle valve in the low opening region of the throttle valve and a vane controller adapted to forcedly shift the vane in a direction to be closed, if the venturi negative pressure is lowered, in the high opening region of the throttle valve.

DETAILED DESCRIPTION OF THE PREFERRED EMBODIMENT

Figure 1:
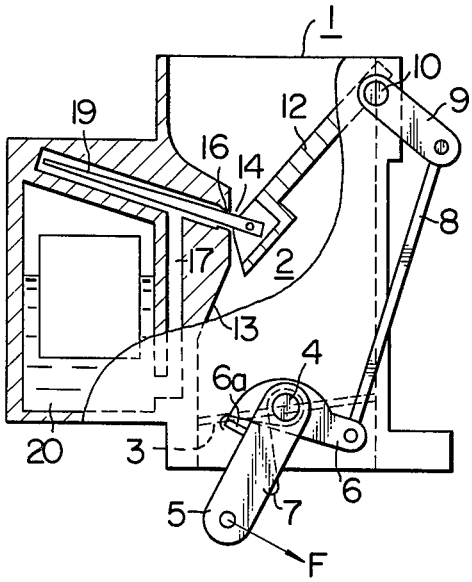
FIG. 1 PRIOR ART
FIG. 1 is a longitudinal cross-sectional view of a conventional variable stage type carburetor.

FIG. 1 shows a variable stage type carburetor known in the art, and the body proper 1 of the carburetor is formed therein with an intake passage 2 in the vertical direction. A throttle valve 3 controlling the flow rate of air-fuel mixture flowing through the passage 2 is mounted on a shaft 4 in the lower portion of the intake passage 2. A lever 5 is rigidly secured to the throttle valve shaft 4 on which is loosely coupled a connecting lever 6. Confined between the levers 5 and 6 is a coil spring 7 which loads in a manner that an engaging projection **6*a* provided at one end of the lever 6 is urged against a side edge of the lever 5** for engagement.

The lever 6 is connected to a vane lever 9 via a rod 8. The vane lever 9 is rigidly secured to a vane shaft 10 which is rotatably supported by the upper portion of the body proper 1. Additionally, mounted on the vane shaft 10 is a vane 12. A variable venturi-flume 14 is formed between the vane 12 and the inner wall 13 of the intake passage. A fuel passage 17 formed with an orifice 16 is open to the venturi-flume 14. Coupled into the orifice 16 is a jet needle 19 connected to the free end of the vane 12. The fuel passage 17 is in communication with the bottom portion of a float chamber 20.

With the carburetor of construction described above, when the lever 5 is actuated in the direction indicated by an arrow F shown in the drawing, the opening of the throttle valve 3 reaches a given value and at the same time, the opening of the vane 12 also reaches a given value through the medium of the coil spring 7, lever 6, rod 8 and vane lever 9. The cross-sectional area of the venturi-flume 14 is varied commensurate to the opening degree of the vane 12 and the jet needle 19 is shifted to the right commensurate to the opening of the vane 12, so that the metering area defined by the orifice 16 and the needle 19 is varied, thereby supplying an air-fuel mixture of a desirable air-fuel ratio to the engine.

Figure 2:
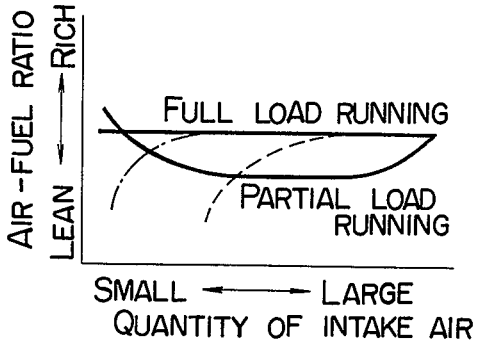
FIG. 2 is a characteristic chart showing the quantity of intake air and the values of air-fuel ratio of air-fuel mixture.

As having been known, the relationship between an air-fuel ratio and a quantity of intake air are preferable to be kept as shown by solid lines in FIG. 2. Namely, it is preferable that during partially load running, the air-fuel ratio of the mixture supplied to the engine is kept small (the mixture being rich) in the case that the quantity of intake air is very small or very large and is kept large (the mixture being lean) in the cases other than the above. During full load running, the mixture is preferable to be constantly maintained in a comparatively rich condition.

However, with the conventional carburetor shown in FIG. 1, such a problem was encountered that, in the full load running, if the quantity of intake air becomes small, then the air-fuel mixture becomes too lean, as shown by a broken line and a one-dot chain line in FIG. 2, thereby unabling to perform a stable condition of running. More specifically, it is presumed that, if the partial load running condition where the opening of the throttle valve 3 is maintained at a certain value is changed into the full load running condition due to the change in load, then R. P. M. of the engine is lowered and the quantity of intake air is decreased so that the venturi negative pressure becomes smaller, thereby decreasing the fuel flow rate with the resulting lean mixture charge.

Consequently, in the case that the venturi negative pressure is decreased with the decrease in the quantity of intake air, if the opening of the throttle valve is maintained at the same position and only the opening of the vane is made small, then the decrease in the venturi negative pressure can be prevented.

Figure 3:
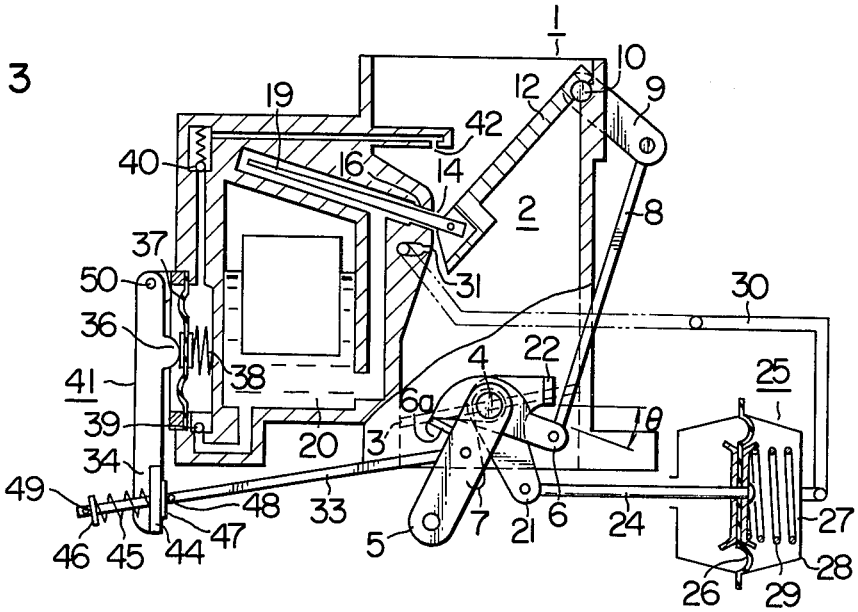
FIG. 3 is a longitudinal cross-sectional view of a variable stage type carburetor embodying the present invention.

FIG. 3 shows a variable stage type carburetor embodying the present invention. In this embodiment, a control lever 21 is loosely coupled to the throttle valve shaft 4, and integrally provided at one end of the lever 21 is a finger 22 which is adapted to be engaged with the lever 6 at the time when the lever 6 moves in a counterclockwise direction. Connected to the control lever 21 via a rod 24 is a diaphragm 26 of a negative pressure responsive device 25.

The negative pressure responsive device 25 comprises a negative pressure chamber 27 defined by the diaphragm 26 and a housing 28 and a compression spring 29 provided in the negative pressure chamber 27. The negative pressure chamber 27 is communicated through a pipe 30 with a negative pressure port 31 open in the wall surface of the venturi-flume 14 on the side of the body proper of carburetor.

The control lever 21, the negative pressure responsive device 25, the negative pressure pipe 30, the negative pressure port 31 and the like constitute a vane controller. The resilient force of the compression spring 29 urging the diaphragm 26 to the left is predetermined to be stronger than that of the coil spring 7.

With the carburetor described, if the engine is operated by actuating the lever 5 to open the throttle valve 3, then a negative pressure is generated in the venturi-flume 14, and the negative pressure thus generated acts on the negative pressure chamber 27 of the negative pressure responsive device 25 to compress the spring 29 so that the control lever 21 is rotated about the shaft 4 in the counter-clockwise direction. Accordingly, the finger 22 is not in contact with the lever 6. When the lever 6 is not in contact with the finger 22 of the control lever 21, the lever 6 rotates with the lever 5 so that a position of the lever 21 is determined commensurate to a position of the lever 5. However, in the case that the quantity of intake air is small despite of a large opening of the throttle valve 3 during running condition of the engine, the venturi negative pressure becomes small, whereby the force to bias the diaphragm 26 to the right becomes small so that the rod 24 is shifted to the left by the force of the spring 29 and the finger 22 retracts the lever 6 in the clockwise direction, thereby decreasing the opening of the vane 12. At this time, the torsion spring 7 confined between the throttle valve lever 5 and the lever 6 is twisted. Namely, with this embodiment, because the vane controller acts to forcedly retract the opening of the vane at the time when the venturi negative pressure is lowered to less than a certain value, such a shortcoming has been obviated that too much lowered negative pressure results in too much lean mixture charge.

However, in the case that the vane controller is caused to act while the throttle valve still remains at the idle opening, the following problem is presented. For example, in the case that the temperature around the carburetor is so high that percolation is generated, during starting a too rich mixture charge may be fed to the engine, thus resulting in starting failure. In such case, with the carburetor known in the art as shown in FIG. 1, if cranking is performed with the throttle valve opened close to the full opening, then a large quantity of air is sucked into the engine because the vane is fully open, the mixture in cylinders becomes so lean as to enable to start the engine. However, with the carburetor provided with the vane controller, because the venturi negative pressure generated during cranking of the engine is so small that it cannot cause the control lever to be rotated, no matter how large the throttle valve is opened, the vane remains at the idle opening, and the rich mixture charge is still sucked in, thus compounding the difficulties in starting.

Then, according to the present invention, such solutions are presented that the vane controller does not act in the low opening region of the throttle valve and a fuel feed pump 41 is provided for remedying the lean mixture charge in the low opening region.

The embodiment of the present invention will be described in more detail with reference to FIG. 3. A lever 6 is angularly spaced an angle $\theta$ clockwise from a finger 22 of a control lever 21, when the venturi negative pressure is at zero, with the throttle valve 3 remaining at an idle opening. In other words, when the throttle valve is opened through an angle $\theta$ from the idle opening, the lever 6 contacts the finger 22 of the control lever 21 at a zero venturi negative pressure. Accordingly, during the time, in which the throttle valve 3 is opened through an angle $\theta$ from an idle opening, a vane 12 is opened at an angle commensurate to the opening of the throttle valve 3, and a vane controller is not affected, even if a venturi generative pressure is small. Accordingly, in the case of percolation, when the throttle valve 3 is opened and cranking is effected, then fuel is not extracted under vacuum at an air flow rate upon cranking, because the vane 12 is opened to an extent that the lever 6 contacts the finger 22, so that a mixture charge in a cylinder may be rendered leaner.

In case the throttle valve is opened so as to accelerate an engine from its idle running, the throttle valve 3 and vane 12 maintain mechanical cooperation, until the opening of the throttle valve 3 reaches $\theta$, so presenting possibilities of the venturi negative pressure being small and a mixture charge being rendered leaner. To cope with this, the present invention adopted a fuel supply pump, i.e., an accelerator pump 41.

Figure 4:
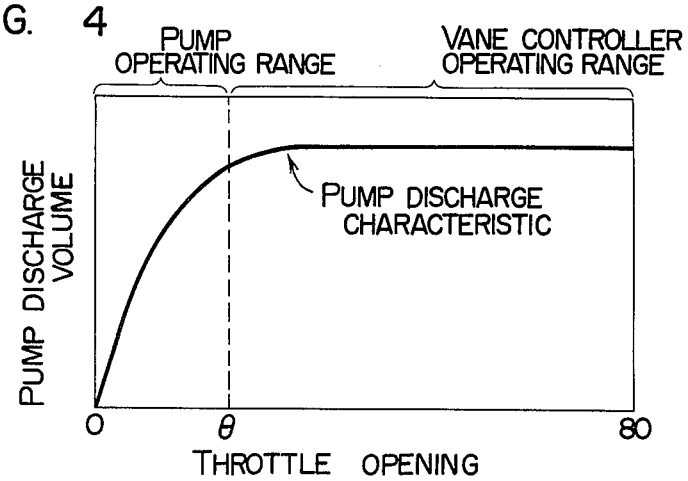
FIG. 4 is a graph showing the relationship between the pump discharge volume and the throttle opening.

The accelerator pump 41 is provided on the side surface of a float chamber 20, and includes a diaphragm 37, spring 38, suction valve 39, and discharge valve 40 and the like. A pump lever 34 adapted to operate the diaphragm 37 has its top end coupled to a pin 50 in a rotatable manner, and an intermediate portion which is formed with a projecting portion 36 engageable with the diaphragm 37. The lower end of the pump lever 34 is formed with a projecting portion 44 integrally, and the projecting portion 44 has an opening adapted to admit a rod 33 therein. The rod 33 extends through an opening in the projecting portion 44 in a movable manner, and has washers 46, 47 and pins 48, 49 on the opposite sides of the projecting portion 44. A coil spring 45 is confined between the washer 46 and the projecting portion 44, thereby urging the washer 47 against the projecting portion 44. The spring 45 is stronger in its force than the spring 38. The right-hand end of the rod 33 is pivoted to the lever 5, so that the counterclockwise rotation of the lever 5 causes the pump lever 24 to rotate counterclockwise, thereby operating the accelerator pump 41. In this respect, the pump lever 34 is rotated in cooperation with the rotation of the lever 5 only when the throttle valve 3 is angularly displaced through an angle $\theta$ from the idle opening. However, the stroke of pump lever 34 is so designed that, even if the lever 5 is rotated to a further extent, the pump lever 34 can no longer be rotated. Thus, when the lever 5 is rotated counterclockwise from an idle condition shown in FIG. 3, then the lever 34 is rotated counterclockwise to operate the pump 41, thereby allowing the fuel in a pump chamber to be discharged through a nozzle 42. When the lever 5 is angularly displaced through an angle $\theta$, then the diaphragm 37 in the pump 41 is displaced to its full stroke, and the lever 34 is not displaced even if the throttle lever 5 is angularly displaced counterclockwise, and as a result, the spring 45 remains compressed. Accordingly, as shown in FIG. 4, a discharge amount of the pump is increased in proportion to an opening of the throttle valve in its range from an idle opening to $\theta°$, while the discharge amount of the pump remains constant in a range from the idle opening to over an angle $\theta$. In other words, if the throttle valve is opened or closed at an angle of no less than $\theta°$, a discharge amount of the pump is maintained at zero.

An opening of the throttle valve for allowing the diaphragm 37 in the pump 41 to be displaced to its full stroke is so designed as to substantially conform with an opening at which the vane-controller 25 begins operating. The pump does not discharge fuel in an operating range of the vane controller 25. This prevents development of an excessively righ mixture charge due to the simultaneous operation of the vane controller 25 and accelerator pump.

It is preferable that an angle $\theta$ of the throttle valve be minimized, at which angle the vane controller does not operate, as far as the starting performance of an engine in the event of percolation is not impaired.

According to the embodiment shown in FIG. 3, in case an opening of the throttle valve 3 is greater than an idle opening by no less than $\theta°$, the vane controller acts so as to forcedly rotate the vane in the direction to be closed, commensurate to a decrease in the venturi negative pressure, thereby avoiding a shortcoming in that a mixture charge becomes excessively leaner, because of too lower venturi negative pressure. In addition, in case a negative pressure is lowered at a smaller opening of the throttle valve 3 and hence a mixture charge becomes lean, the throttle valve 3 is rotated from its idle position to the direction to be opened wider, so that the accelerator pump 41 is operated, and an additional amount of fuel is supplied to a mixture charge, so that mixture charge is prevented from being too lean. In the case of percolation, the throttle valve 3 is fully opened and cranking is effected. This is because the lever 6 is opened to an extent that the lever 6 abuts the finger 22, and as a result a venturi negative pressure remains lowered, with the result that a mixture charge in a cylinder may be rendered leaner.

In the aforesaid embodiment, a negative pressure responsive device is used as a vane controller, which causes a displacement commensurate to a venturi negative pressure. The above negative pressure responsive device is simple in construction, but the present invention is by no means limited to this instance. In place of the negative pressure responsive device, there may be used such a device, in which a venturi negative pressure is taken out as an electric signal by means of a sensor, and then a comparator solenoid is operated according to the electric signal thus obtained for compensating for an opening of the vane. Meanwhile, in the aforesaid embodiment, an operational range of the accelerator pump is separated from an operational range of the vane controller. However, the both range should not necessarily be separated accurately, but may overlap each other partially.

What is claimed is:

1. In a variable stage type carburetor including: an intake passage; a throttle valve positioned in said intake passage; a movable venturi vane positioned upstream of said throttle valve in said intake passage, said venturi vane being cooperative with the inner wall of said intake passage for providing a variable venturi; and means for operatively connecting said venturi vane to said throttle valve by the medium of a resilient member, whereby said venturi vane may be angularly displaced commensurate to an opening of said throttle valve; the improvements comprising:

a vane controller for forcedly decreasing an opening of said movable vane, when a venturi negative pressure is lowered in response to a negative pressure in said venturi portion at such an opening of said throttle valve, which is greater than a given opening;

a fuel supply pump for additionally supplying fuel into said intake passage;

a connecting means for operably connecting said throttle valve to said fuel supply pump so as to operate said fuel supply pump in response to an opening action of said throttle valve, said connecting means being so designed that said pump may be operated throughout the entire stroke thereof, during the time in which said throttle valve is opened from its closed position to said given opening.

2. The improvements as set forth in claim 1, wherein said connecting means provided for said pump and said throttle valve includes resilient means which may be displaced, when said throttle valve is further angularly displaced in the direction to increase an opening, after said pump has been displaced to its full stroke position.

3. The improvements as set forth in claim 2, wherein said connecting means further includes a rod linked to said throttle valve, and a pump lever, said resilient means including a spring provided between said rod and said lever.

* * * * *